US008905127B2

(12) United States Patent
Banerjee et al.

(10) Patent No.: US 8,905,127 B2
(45) **Date of Patent: *Dec. 9, 2014**

(54) PROCESS FOR ENHANCED PRODUCTION OF HEAVY OIL USING MICROWAVES

(75) Inventors: Dwijen K. Banerjee, Owasso, OK (US); John L. Stalder, Calgary (CA); Maxine Jones Madison, Houston, TX (US); Wayne Reid Dreher, Jr., College Station, TX (US)

(73) Assignee: ConocoPhillips Company, Houston, TX (US)

( * ) Notice: Subject to any disclaimer, the term of this patent is extended or adjusted under 35 U.S.C. 154(b) by 409 days.

This patent is subject to a terminal disclaimer.

(21) Appl. No.: 13/155,022

(22) Filed: Jun. 7, 2011

(65) Prior Publication Data

US 2011/0253363 A1 Oct. 20, 2011

Related U.S. Application Data

(63) Continuation-in-part of application No. 12/239,051, filed on Sep. 26, 2008, now Pat. No. 7,975,763.

(60) Provisional application No. 61/383,230, filed on Sep. 15, 2010, provisional application No. 61/466,342, filed on Mar. 22, 2011.

(51) Int. Cl.
*E21B 43/24* (2006.01)

(52) U.S. Cl.
USPC ..... 166/248; 166/263; 166/272.1; 166/272.3; 166/272.6; 166/272.7; 166/302; 166/303

(58) Field of Classification Search
USPC ..... 166/60, 65.1, 248, 249, 263, 272.1, 166/272.3, 272.6, 272.7, 302, 303, 306
See application file for complete search history.

(56) References Cited

U.S. PATENT DOCUMENTS

| | | | |
|---|---|---|---|
| 4,094,798 | A | 6/1978 | Tate et al. |
| RE30,738 | E | 9/1981 | Bridges et al. |
| 4,457,365 | A | 7/1984 | Kasevich et al. |
| 4,485,868 | A | 12/1984 | Sresty et al. |
| 4,620,593 | A | 11/1986 | Haagensen |
| 4,638,863 | A | 1/1987 | Wilson |
| 4,700,716 | A | 10/1987 | Kasevich et al. |
| 4,817,711 | A | 4/1989 | Jeambey |
| 4,912,971 | A | 4/1990 | Jeambey |
| 5,082,054 | A | 1/1992 | Kiamanesh |
| 5,109,927 | A | 5/1992 | Supernaw et al. |

(Continued)

FOREIGN PATENT DOCUMENTS

| | | |
|---|---|---|
| GB | 0896407 | 5/1962 |
| JP | 5112004104 | 10/1976 |
| WO | 20071081493 A2 | 7/2007 |

OTHER PUBLICATIONS

Deutsch, C.V. and McLennan, J.A., Guide to SAGD (Steam Assisted Gravity Drainage) Reservoir Characterization Using Geostatistics, 2005, Centre for Computational Geostatistics. cited by other.

*Primary Examiner* — George Suchfield
(74) *Attorney, Agent, or Firm* — ConocoPhillips Company

(57) ABSTRACT

A process for utilizing microwaves to heat $H_2O$ within a subterranean region wherein the heated $H_2O$ contacts heavy oil in the subterranean region to lower the viscosity of the heavy oil and improve production of the heavy oil.

20 Claims, 4 Drawing Sheets

(56) References Cited

U.S. PATENT DOCUMENTS

| | | | | |
|---|---|---|---|---|
| 5,321,222 | A | 6/1994 | Bible et al. | |
| 5,521,360 | A | 5/1996 | Johnson et al. | |
| 5,899,274 | A | 5/1999 | Frauenfeld et al. | |
| 6,012,520 | A | 1/2000 | Yu et al. | |
| 6,544,411 | B2 | 4/2003 | Varadaraj | |
| 6,814,141 | B2 | 11/2004 | Huh et al. | |
| 7,073,577 | B2 | 7/2006 | Yu | |
| 7,091,460 | B2 | 8/2006 | Kinzer | |
| 7,461,693 | B2 | 12/2008 | Considine et al. | |
| 7,484,561 | B2 | 2/2009 | Bridges | |
| 7,677,673 | B2 | 3/2010 | Tranquilla et al. | |
| 7,975,763 | B2 * | 7/2011 | Banerjee et al. | 166/248 |
| 2005/0199386 | A1 | 9/2005 | Kinzer | |
| 2007/0131591 | A1 | 6/2007 | Pringle | |
| 2007/0289736 | A1 | 12/2007 | Kearl et al. | |
| 2008/0073079 | A1 | 3/2008 | Tranquilla et al. | |
| 2009/0071648 | A1 | 3/2009 | Hagen et al. | |
| 2009/0139716 | A1 | 6/2009 | Brock et al. | |
| 2010/0294488 | A1 * | 11/2010 | Wheeler et al. | 166/248 |
| 2010/0294489 | A1 * | 11/2010 | Dreher et al. | 166/248 |
| 2012/0061080 | A1 * | 3/2012 | Sultenfuss et al. | 166/302 |
| 2012/0085533 | A1 * | 4/2012 | Madison et al. | 166/248 |

* cited by examiner

PROCESS FOR ENHANCED PRODUCTION OF HEAVY OIL USING MICROWAVES

CROSS-REFERENCE TO RELATED APPLICATIONS

This application is a continuation-in-part application which claims benefit under 35 USC §120 to U.S. application Ser. No. 12/239,051 filed Sep. 26, 2008 entitled "PROCESS FOR ENHANCED PRODUCING OF HEAVY OIL USING MICROWAVES," incorporated herein in their entirety and a non-provisional application which claims benefit under 35 USC §119(e) to U.S. Provisional Application Ser. No. 61/383,230 filed Sep. 15, 2010 entitled "IN SITU UPGRADING WITH RADIO FREQUENCY RADIATION FOLLOWING CYCLIC STEAM STIMULATION" (CSS) and U.S. Provisional Application Ser. No. 61/466,342 filed Mar. 22, 2011 entitled "IN SITU UPGRADING WITH FREQUENCY RADIATION FOLLOWING CYCLIC STEAM STIMULATION" which is incorporated herein in its entirety.

STATEMENT REGARDING FEDERALLY SPONSORED RESEARCH OR DEVELOPMENT

None.

FIELD OF THE INVENTION

The present invention relates generally to a process for recovering heavy oil from a reservoir.

BACKGROUND OF THE INVENTION

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Viscous oil that is too deep to be mined from the surface may be heated with hot fluids or steam to reduce the viscosity sufficiently for recovery by production wells. One thermal method, known as steam assisted gravity drainage (SAGD), provides for steam injection and oil production to be carried out through separate wellbores. The optimal configuration is an injector well which is substantially parallel to and situated above a producer well, which lies horizontally near the bottom of the formation. Thermal communication between the two wells is established and, as oil is mobilized and produced, a steam chamber or chest develops. Oil at the surface of the enlarging chest is constantly mobilized by contact with steam and drains under the influence of gravity.

There are several patents on the improvements to SAGD operation. U.S. Pat. No. 6,814,141 describes applying vibrational energy in a well fracture to improve SAGD operation.

U.S. Pat. No. 5,899,274 teaches addition of solvents to improve oil recovery. U.S. Pat. No. 6,544,411 describes decreasing the viscosity of crude oil using ultrasonic source. U.S. Pat. No. 7,091,460 claims in situ, dielectric heating using variable radio frequency waves.

In a recent patent publication (U.S. Patent Publication 20070289736/US-A1, filed May 25, 2007), it is disclosed to extract hydrocarbons from a target formation, such as a petroleum reservoir, heavy oil, and tar sands by utilizing microwave energy to fracture the containment rock and for liquification or vitalization of the hydrocarbons.

In another recent patent publication (US Patent Publication 20070131591/US-A1, filed Dec. 14, 2006), it is disclosed that lighter hydrocarbons can be produced from heavier carbon-base materials by subjecting the heavier materials to microwave radiations in the range of about 4 GHz to about 18 GHz. This publication also discloses extracting hydrocarbons from a reservoir where a probe capable of generating microwaves is inserted into the oil wells and the microwaves are used to crack the hydrocarbons with the cracked hydrocarbon thus produced being recovered at the surface.

Despite these disclosures, it is unlikely that direct microwave cracking or heating of hydrocarbons would be practical or efficient. It is known that microwave energy is absorbed by a polar molecule with a dipole moment and bypasses the molecules that lack dipole moment. The absorption of the microwave energy by the polar molecule causes excitation of the polar molecule thereby transforming the microwave energy into heat energy (known as the coupling effect). Accordingly, when a molecule with a dipole moment is exposed to microwave energy it gets selectively heated in the presence of non-polar molecules. Generally, heavy oils comprise non-polar hydrocarbon molecules; accordingly, hydrocarbons would not get excited in the presence of microwaves.

Additionally, while the patent publication above claims to break the hydrocarbon molecules, the energy of microwave photons is very low relative to the energy required to cleave a hydrocarbon molecule. Thus, when hydrocarbons are exposed to microwave energy, it will not affect the structure of a hydrocarbon molecule. (See, for example, "Microwave Synthesis", CEM Publication, 2002 by Brittany Hayes).

Conventional cyclic steam stimulation involves the process of injecting a predetermined amount of steam into wells that have been drilled or converted for injection purposes. These wells are then shut in to allow the steam to heat or "soak" the producing formation around the well. After a sufficient time has elapsed to allow adequate heating, the injection wells are put back in production until the heat is dissipated with the producing fluids. Each cycle can last from weeks to months and this process continues until the reservoir is depleted or it is no longer economically feasible to produce.

There exists a need to combine the technology of conventional cyclic steam stimulation with in situ upgrading to both increase the amount of oil produced from the reservoir and in situ upgrade the oil from the reservoir.

BRIEF SUMMARY OF THE DISCLOSURE

A process of injecting $H_2O$ into a subterranean region through a first wellbore of a cyclic steam stimulation operation. Microwaves are introduced into the region at a frequency sufficient to excite the $H_2O$ molecules and increase the temperature of at least a portion of the $H_2O$ within the region to produce steam. The subterranean region is then soaked with the steam. Revaporized steam and superheated steam are then produced by directing the microwaves to the steam and $H_2O$ molecules. At least a portion of the heavy oil in the region is heated by contact with the revaporized steam and the superheated steam to produce heated heavy oil. Heated heavy oil is then produced through a second wellbore of the cyclic steam stimulation operation, thereby recovering heavy oil with the cyclic steam stimulation operation from a subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore. Furthermore it is important to note that the temperature of the superheated steam is greater than the temperature of the revaporized steam and the steam.

In another embodiment a process is describes injecting liquid $H_2O$ into a region through a first wellbore of a cyclic steam stimulation operation. Microwaves are introduced into a subterranean region at a frequency sufficient to excite the liquid $H_2O$ molecules and increase the temperature of at least a portion of the liquid $H_2O$ within the region to produce steam. The subterranean region is stoked with the steam. Revaporized steam and superheated steam is produced by directing the microwaves to the steam and $H_2O$ molecules. At least a portion of the heavy oil the in region is heated by contact with the revaporized steam and superheated steam to produce heated heavy oil. Heated heavy oil is then produced through a second wellbore of the cyclic steam stimulation operation, thereby recovering heavy oil with the cyclic steam stimulation operation from a subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore. Furthermore it is important to note that the temperature of the superheated steam is greater than the temperature of the revaporized steam and the steam.

In yet another embodiment a process begins with injecting $H_2O$ into a subterranean region through an injection wellbore of a cyclic steam stimulation operation. Microwaves are introduced into the region at a frequency sufficient to excite the $H_2O$ molecules and increase the temperature of at least a portion of the $H_2O$ within the region to produce steam. The subterranean region is then soaked with the steam. Revaporized steam and superheated steam are then produced by directing the microwaves to the steam and $H_2O$ molecules. At least a portion of the heavy oil in the region is then heated by contact with the revaporized steam and the superheated steam to product heated heavy oil. Heated heavy oil is then produced through a second wellbore of the cyclic steam stimulation operation, thereby recovering heavy oil with the cyclic steam stimulation operation from a subterranean region. In this embodiment a portion of the $H_2O$ is injected as steam and the steam contacts with at least a portion of the heavy oil in the region so as to heat the portion of the heavy oil and reduce its viscosity so that it flows generally towards the second wellbore. Furthermore it is important to note that the temperature of the superheated steam is greater than the temperature of the revaporized steam and the steam and that the total time soaking the bitumen with the steam and soaking the bitumen with the revaporized steam and the superheated steam is greater than 30 days. Additionally the injection wellbore and the production wellbore are from 3 meters to 7 meters apart and the injection wellbore is located higher than the production wellbore.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In this description, the term water is used to refer to $H_2O$ in a liquid state and the term steam is used to refer to $H_2O$ in a gaseous state.

Figure 1:
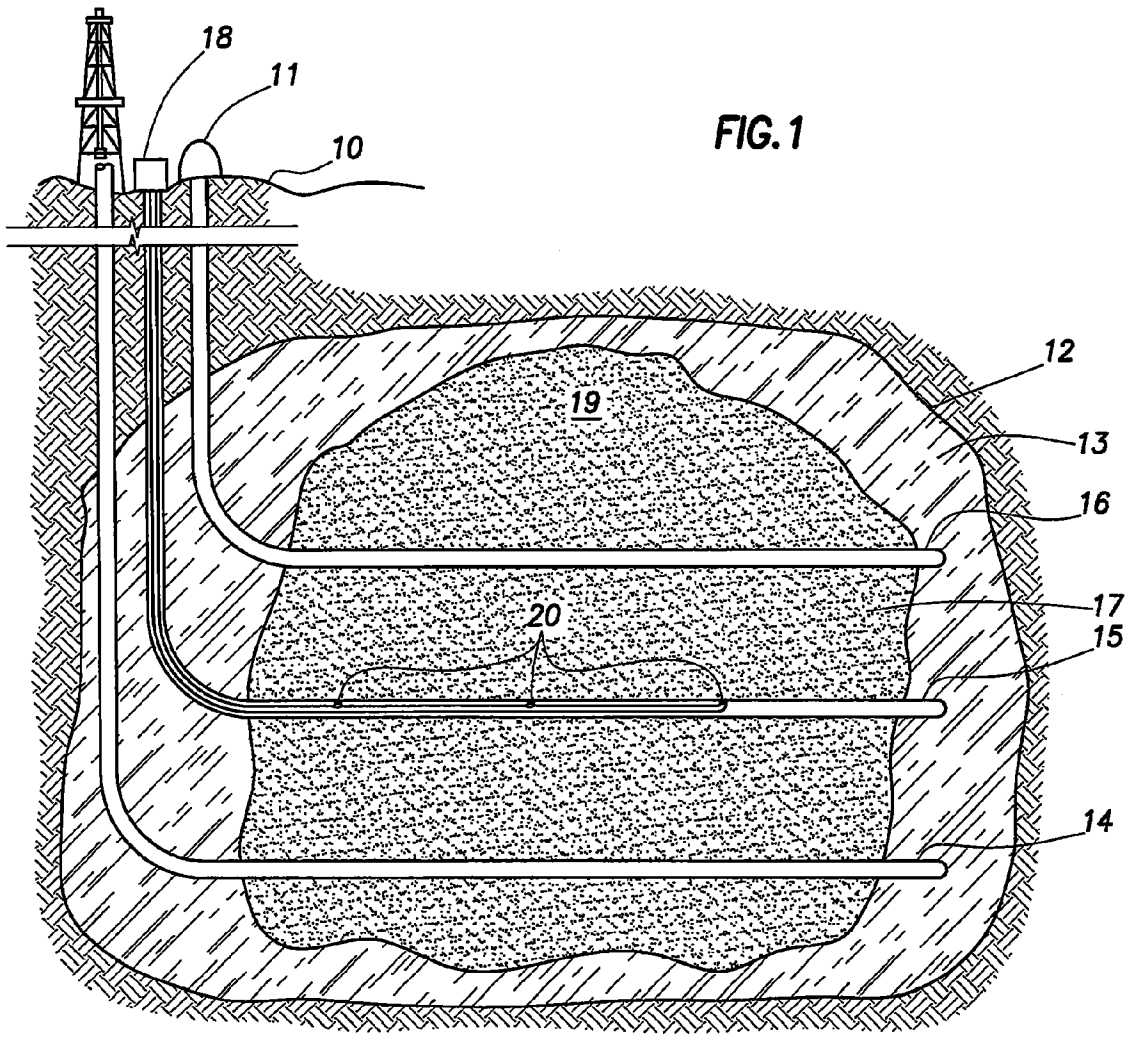
FIG. 1 is a schematic diagram illustrating a heavy oil heating process, wherein wave guides are used to introduce the microwaves to the reservoir.

Turning now to FIG. 1, wellbores 14, 15 and 16 are illustrated. Wellbore 14 extends from the surface 10 into a lower portion of subterranean region 12. Wellbore 16 extends from the surface 10 into subterranean region 12 and generally will be higher than wellbore 14. Wellbore 16 will be used to inject $H_2O$ and it is preferred that it is located higher than wellbore 14 so that when the injected $H_2O$ heats the heavy oil, the heavy oil will flow generally towards wellbore 14, which is used to extract the heavy oil from the reservoir. In one embodiment a portion of the $H_2O$ is injected as steam and the steam contacts with at least a portion of the heavy oil in the region so as to heat the portion of the heavy oil and reduce its viscosity so that it flows generally towards the second wellbore. Wellbore 15 is used to introduce microwaves to the reservoir and it is preferred that wellbore 15 be located intermittent to wellbores 14 and 15; although, other arrangements are possible.

In operation, steam generated in boiler 11 is provided into the reservoir 12 through upper wellbore leg 16. The steam heats the heavy oil within zone 17 of the oil-bearing portion 13 of reservoir 12 causing it to become less viscous and, hence, increase its mobility. The heated heavy oil flows downward by gravity and is produced through wellbore leg 14. While FIG. 1 illustrates a single wellbore for injection and a single wellbore for extraction, other configurations are within the scope of the invention, for example, there can be two or more separate wellbores to provide steam injection and two or more separate wellbores for production. Similarly, multiple wellbores can be used for microwave introduction to the reservoir, as further discussed below.

Steam is used to soak the subterranean region. After soaking the subterranean region with steam, revaporized steam and superheated steam are produced by directing the microwaves to the steam and water molecules. In this embodiment the temperature of the superheated steam is greater than the temperature of the revaporized steam and the steam. Essentially, superheated steam is steam which is at a higher temperature than conventional steam or revaporized steam.

In one embodiment the temperature of the steam can range from 220° C. to 250° C. The temperature of the revaporized steam can range from 220° C. to 250° C., even upwards of 250° C. when the superheated steam is accounted for. The increased temperature of the superheated steam allows for the superheated steam to heat the bitumen to a temperature higher than was previously possible by steam alone. In one embodiment the temperature of the superheated steam would be sufficient to catalytically crack the oil in the reservoir.

In one embodiment a catalyst can be used in the process and can be present either as particles within the reservoir or as a liner on the wall of the well. The addition of catalysts can decrease the viscosity and increase the API gravity of the oil produced as compared to traditional cyclic steam stimulation. Types of catalyst that can be utilized include metal sulfides, metal carbides and other refractory type metal compounds. Examples of metal sulfides include $MoS_2$, $WS_2$, CoMoS, NiMoS and other commonly known by one skilled in the art. Examples of metal carbides include MoC, WS and others commonly known by one skilled in the art. Examples of refractory type metal compounds include metal phosphides, borides and others commonly known by one skilled in the art.

Hydrogen gas can also be added to the injected steam, the revaporized steam and/or the superheated steam either downhole or on the surface to stabilize the hydrocarbons so that it is easily transportable. In one embodiment it is preferred that it is added at a partial pressure from 600 to 800 psi or even 50 to 1,200 psi.

Generally, the wellbore for steam injection, wellbore 16, will be substantially parallel to and situated above the wellbore for production, wellbore 14, which is located horizontally near the bottom of the formation. Pairs of steam injection wellbores and production wellbores will generally be close together and located at a suitable distance to create an effective steam chamber and yet minimizing the preheating time. Typically, the pairs of injection and production wellbores will be from about 3 meters to 7 meters apart and preferably there will be about 5 meters of vertical separation between the injector and producer wellbores. In other embodiments it is possible for the injection and production wellbores be anywhere from 1, 3, 5, 7, 12, 15, 20 even 25 meters of horizontal separation apart. Additionally, in other embodiments it is possible for the injection and production wellbores be anywhere from 1, 3, 5, 7, 12, 15, 20 even 25 meters of vertical separation apart. In this type of SAGD operation, the zone 17 is preheated by steam circulation until the reservoir temperature between the injector and producer wellbore is at a temperature sufficient to drop the viscosity of the heavy oil so that it has sufficient mobility to flow to and be extracted through wellbore 14. Generally, the heavy oil will need to be heated sufficiently to reduce its viscosity to below 3000 cP; however, lower viscosities are better for oil extraction and, thus, it is preferable that the viscosity be below 1500 cP and more preferably below 1000 cP. Preheating zone 17 involves circulating steam inside a liner using a tubing string to the toe of the wellbore. Both the injector and producer would be so equipped. Steam circulation through wellbores 14 and 16 will occur over a period of time, typically about 3 months. During the steam circulation, heat is conducted through the liner wall into the reservoir near the liner. At some point before the circulation period ends, the temperature midway between the injector and producer will reach a temperature wherein the bitumen will become movable typically around 3000 cP or less or from about 80 to 100° C. Once this occurs, the steam circulation rate for wellbore 14 will be gradually reduced while the steam rate for the injector wellbore 16 will be maintained or increased. This imposes a pressure gradient from high, for the area around wellbore 16, to low, for the area around wellbore 14. With the oil viscosity low enough to move and the imposed pressure differential between the injection and production wellbores, steam (usually condensed to hot water) starts to flow from the injector into the producer. As the steam rate is continued to be adjusted downward in wellbore 14 and upward in wellbore 16, the system arrives at steam assisted gravity drainage operation with no steam injection through wellbore 14 and all the steam injection through wellbore 16. Once hydraulic communication is established between the pair of injector and producer wellbores, steam injection in the upper well and liquid production from the lower well can proceed. Due to gravity effects, the steam vapor tends to rise and develop a steam chamber at the top section 19 of zone 17. The process is operated so that the liquid/vapor interface is maintained between the injector and producer wellbores to form a steam trap which prevents live steam from being produced through the lower wellbore.

During operation, steam will come into contact with the heavy oil in zone 17 and, thus, heat the heavy oil and increase its mobility by lessening its viscosity. Heated heavy oil will tend to flow downward by gravity and collect around wellbore 14. Heated heavy oil is produced through wellbore 14 as it collects. Steam contacting the heavy oil will lose heat and tend to condense into water. The water will also tend to flow downward toward wellbore 14. In past SAGD operations, this water would also be produced through wellbore 14. Such produced water would need to be treated to reduce impurities before being reheated in the boiler for subsequent injection. As the process continues operation, zone 17 will expand with heavy oil production occurring from a larger portion of oil-bearing portion 13 of subterranean formation 12.

Turning again to FIG. 1, the current invention provides for microwave generator 18 to generate microwaves which are directed underground and into zone 17 of the reservoir through a series of wave guides 20. The diameter of the wave guides will preferably be more than 3 inches in order to ensure good transmission of the microwaves. Within the reservoir, the microwaves will be at a frequency substantially equivalent to the resonant frequency of the water within the reservoir so that the microwaves excite the water molecules causing them to heat up. Optimally, the microwaves will be introduced at or near the liquid vapor interface so that condensed steam is reheated from its water state back into steam further supplying the steam chamber. In some embodiments the microwave frequency will be not greater than 3000 megahertz and/or at a resonant frequency of water. Based on the resonant frequency of water, the optimum frequency will be 2450 megahertz; however, power requirements and other factors may dictate that another frequency is more economical. Additionally, salt and other impurities may enhance the coupling effect (production of heat by resonance of a polar or conductive molecule with microwave energy); thus, the presence of salt is desirable.

Figure 2:
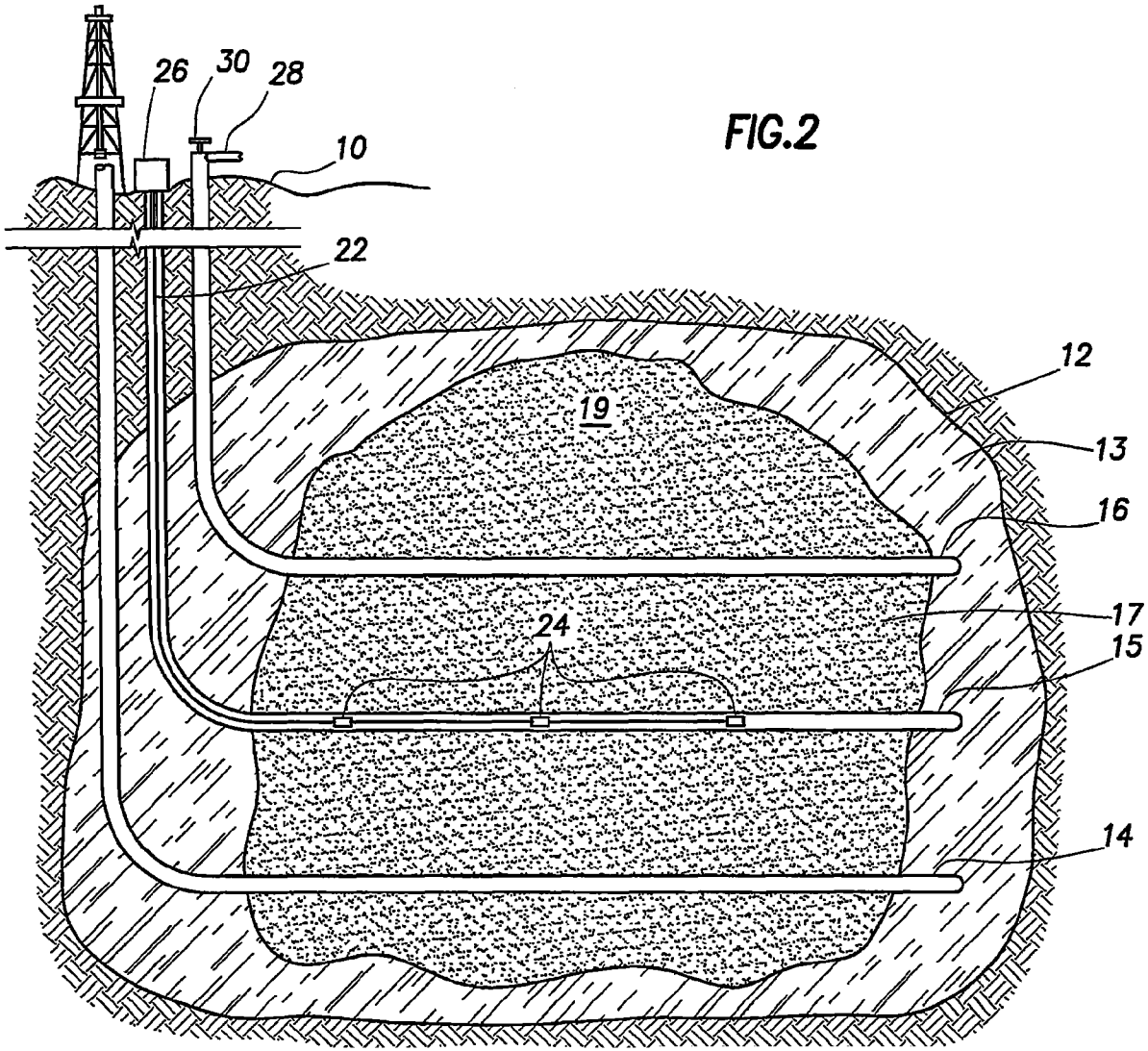
FIG. 2 is a schematic diagram illustrating a heavy oil heating process wherein the microwaves are introduced into the reservoir using a microwave generator located within the reservoir.

Turning now to FIG. 2, a further embodiment of the invention is illustrated wherein, instead of using wave guides, power is supplied through electrical wire 22 to microwave generating probe 24. The electrical power can be supplied to wire 22 by any standard means such as generator 26.

In still another embodiment of the invention, also illustrated in FIG. 2, no steam boiler is used. Instead water is introduced directly into wellbore 16 through pipe 28 and valve 30. Wellbore 16 then introduces water into the reservoir instead of steam and the entire steam production would be accomplished through use of the microwave generators. This embodiment of the invention has the added advantage of avoiding costly water treatment that is necessary when using a boiler to generate steam because, as discussed above, salt and other impurities can aid in heat generation. In a preferred embodiment, the water introduced into the reservoir would have a salt content greater than the natural salt content of the reservoir, which is typically about 5,000 to 7,000 ppm. Accordingly, it is preferred that the introduced water has a salt content greater than 10,000 ppm. For enhanced heat generation 30,000 to 50,000 ppm is more preferred.

Figure 3:
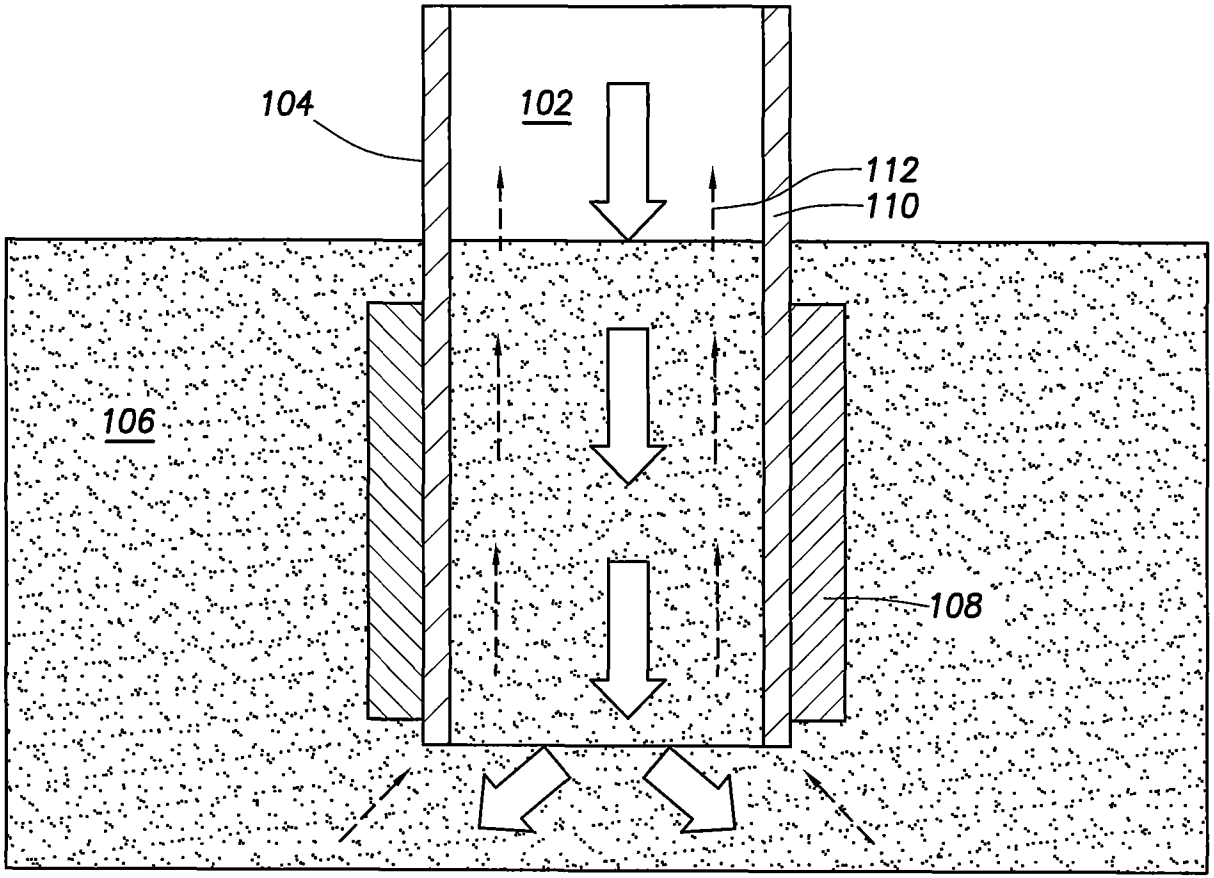
FIG. 3 is a schematic diagram illustrating a heavy oil heating process wherein a catalyst is placed as a liner alongside the well.

FIG. 3 describes an embodiment of cyclic steam stimulation, wherein a catalyst is placed as a liner alongside the well. In this embodiment steam 102 is injected into a well 104. The steam 102 heats the bitumen 106 in the formation. When the required temperature is achieved the injection of steam 102 into the well 104 is ceased. The bitumen 106 is soaked with the steam 102 for a period of time. MW and/or RF radiation is then directed into the well from a MW/RF antennal 108. In this embodiment the catalyst 110 is placed as a liner alongside the well 104. The MW and/or RF radiation is capable of heating the steam 102 into superheated steam and revaporized steam, which has a higher temperature than of the steam. The bitumen 106 is then further heated with this superheated steam and any steam that has revaporized. Hydrocarbons 112 are then produced from the well 104.

Figure 4:
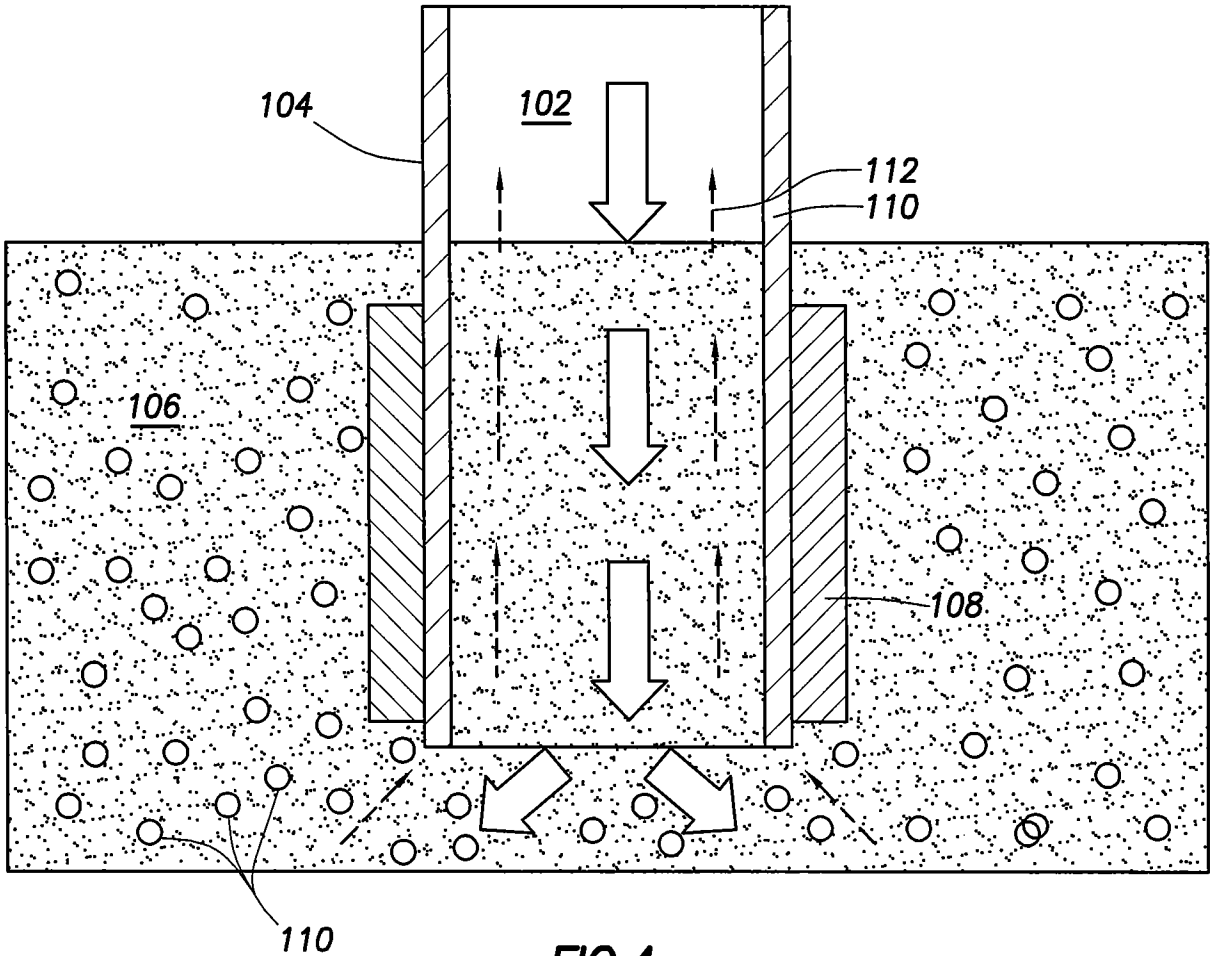
FIG. 4 is a schematic diagram illustrating a heavy oil heating process wherein a catalyst is placed as particles in the formation.

FIG. 4 describes an embodiment of cyclic steam stimulation, wherein a catalyst is placed as particles in the formation. In this embodiment steam 102 is injected into a well 104. The steam 102 heats the bitumen 106 in the formation. When the required temperature is achieved the injection of steam 102 into the well 104 is ceased. The bitumen 106 is soaked with the steam 102 for a period of time. MW and/or RF radiation is then directed into the well 104 from a MW/RF antenna 108. In this embodiment the catalyst 110 are dispersed throughout the formation. The MW and/or RF radiation is capable of heating the steam 102 into superheated steam and revaporized steam, which has a higher temperature than of the steam. The bitumen 6 is then further heated with this superheated steam and any steam that has revaporized. Hydrocarbons 112 are then produced from the well 104.

Microwave generators useful in the invention would be ones suitable for generating microwaves in the desired frequency ranges recited above. Microwave generators and wave guide systems adaptable to the invention are sold by Cober Muegge LLC, Richardson Electronics and CPI International Inc.

Steam to oil ratio is an important factor in SAGD operations and typically the amount of water required will be 2 to 3 times the oil production. Higher steam to oil production ratios require higher water and natural gas costs. The present invention reduces water and natural gas requirements and reduces some of the water handling involving recycling, cooling, and cleaning up the water.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process comprising:

(a) injecting $H_2O$ into a subterranean region through a first wellbore of a cyclic steam stimulation operation;

(b) introducing microwaves into the region at a frequency sufficient to excite the $H_2O$ molecules and increase the temperature of at least a portion of the $H_2O$ within the region to produce steam;

(c) soaking the subterranean region with the steam;

(d) producing revaporized steam and superheated steam by directing the microwaves to the steam and $H_2O$ molecules;

(e) heating heavy oil in at least a portion of the subterranean region by contact with the revaporized steam and superheated steam to produce heated heavy oil;

(f) producing the heated heavy oil through a second wellbore of the cyclic steam stimulation operation;

thereby recovering heavy oil with the cyclic steam stimulation operation from the subterranean region;

wherein a portion of the $H_2O$ is injected as steam and the steam contacts heavy oil in at least a portion of the subterranean region so as to heat the portion of the heavy oil and reduce its viscosity so that it flows generally towards the second wellbore and wherein the temperature of the superheated steam is greater than the temperature of the revaporized steam and the steam.

2. The process of claim 1 wherein at least a portion of the steam condenses to a liquid state to form water as a result of its contact with heavy oil and wherein the microwaves excite the molecules of at least a portion of the water so that the water is heated and becomes steam.

3. The process of claim 2 wherein the microwaves are generated at the surface and introduced into the subterranean region through at least one waveguide.

4. The process of claim 3, wherein the microwaves have a frequency which is less than or equal to 3000 MHz.

5. The process of claim 4 wherein the microwaves are generated within the subterranean region.

6. The process of claim 5 wherein the microwaves have a frequency which is less than or equal to 3000 MHz.

7. The process of claim 1 further comprising injecting at least a portion of the $H_2O$ as water and wherein the microwaves excite the molecules of at least a portion of the thus injected water so that the water is heated and becomes steam.

8. The process of claim 7 wherein the thus injected water has a salt content of at least 10,000 ppm.

9. The process of claim 7 wherein the steam contacts heavy oil in at least a portion of the subterranean region so as to heat the heavy oil and reduce its viscosity so that it flows generally towards the second wellbore.

10. The process of claim 7 wherein at least a portion of the steam condenses to a liquid state to form water as a result of its contact with the heavy oil and wherein the microwaves excite the molecules of at least a portion of the thus formed water so that the water is heated and becomes steam.

11. The process of claim 10 further comprising injecting at least a portion of the $H_2O$ as water in step (a).

12. The process of claim 11 wherein the thus injected water has a salt content of at least 10,000 ppm.

13. The process of claim 11 wherein the microwaves are generated at the surface and introduced into the region through at least one waveguide.

14. The process of claim 13, wherein the microwaves have a frequency which is less than or equal to 3000 MHz.

15. The process of claim 11 wherein the microwaves are generated within the region.

16. The process of claim 15 wherein the microwaves have a frequency which is less than or equal to 3000 MHz.

17. The process of claim 1, wherein temperature of the steam ranges from 220° C. to 250° C.

18. The process of claim 1, wherein the temperature of the superheated steam ranges from 220° C. to 350° C.

19. A process comprising:

(a) injecting liquid $H_2O$ into a subterranean region through a first wellbore of a cyclic steam stimulation operation;

(b) introducing microwaves into the subterranean region at a frequency sufficient to excite the liquid $H_2O$ molecules and increase the temperature of at least a portion of the liquid $H_2O$ within the subterranean region to produce steam;

(c) soaking the subterranean region with the steam;

(d) producing revaporized steam and superheated steam by directing the microwaves to the steam and $H_2O$ molecules;

(e) heating heavy oil in at least a portion of the subterranean region by contact with the revaporized steam and superheated steam to produce heated heavy oil; and (f) producing the heated heavy oil through a second wellbore of the cyclic steam stimulation operation;

thereby recovering heated heavy oil with the cyclic steam stimulation operation from the subterranean region;

wherein a portion of the liquid $H_2O$ is injected as steam and the steam contacts heavy oil in at least a portion of the subterranean region so as to heat a portion of the heavy oil and reduce its viscosity so that it flows generally towards the second wellbore and wherein the temperature of the superheated steam is greater than the temperature of the revaporized steam and the steam.

20. A process comprising:

(a) injecting $H_2O$ into a subterranean region through an injection wellbore of a cyclic steam stimulation operation;

(b) introducing microwaves into the subterranean region at a frequency sufficient to excite the $H_2O$ molecules and increase the temperature of at least a portion of the $H_2O$ within the subterranean region to produce steam;

(c) soaking the subterranean region with the steam;

(d) producing revaporized steam and superheated steam by directing the microwaves to the steam and $H_2O$ molecules;

(e) heating bitumen to below 3000 cp in at least a portion of the subterranean region by contact with the revaporized steam and superheated steam to produce a heated heavy oil and an imposed pressure differential between the injection wellbore and a production wellbore; and (f) producing the heated heavy oil through the production wellbore of the cyclic steam stimulation operation;

thereby recovering heavy oil with the cyclic steam stimulation operation from the subterranean region wherein the injection wellbore and the production wellbore are from 3 meters to 7 meters apart and the injection wellbore is located higher than the production wellbore;

wherein the $H_2O$ is injected as steam and the steam contacts heavy oil in at least a portion of the subterranean region so as to heat the portion of the heavy oil and reduce its viscosity so that it flows generally towards the production wellbore and wherein the temperature of the superheated steam is greater than the revaporized steam and the steam temperature and wherein the total time soaking the bitumen with the steam and soaking the bitumen with the revaporized steam and the superheated steam is greater than 30 days.

* * * * *